US008272684B2

(12) United States Patent
Obolewicz et al.

(10) Patent No.: US 8,272,684 B2
(45) Date of Patent: Sep. 25, 2012

(54) FOLDING SWIVEL CHAIR

(75) Inventors: Michael Obolewicz, Gilbert, AZ (US); Craig A Hills, Tempe, AZ (US)

(73) Assignee: Revolve, LLC., Gilbert, AZ (US)

( * ) Notice: Subject to any disclaimer, the term of this patent is extended or adjusted under 35 U.S.C. 154(b) by 250 days.

(21) Appl. No.: 12/655,401

(22) Filed: Dec. 30, 2009

(65) Prior Publication Data

US 2011/0156449 A1 Jun. 30, 2011

(51) Int. Cl.
*A47C 4/42* (2006.01)

(52) U.S. Cl. ..... 297/16.2; 297/45

(58) Field of Classification Search ..... 297/16.1, 297/16.2, 45; 248/435
See application file for complete search history.

(56) References Cited

U.S. PATENT DOCUMENTS 476,805 A * 6/1892 Mason ..... 297/461
517,929 A * 4/1894 March ..... 297/461
882,468 A * 3/1908 Huebner et al. ..... 248/435
1,408,581 A * 3/1922 Gaudreau et al. ..... 108/128
1,527,941 A * 2/1925 Weidner ..... 248/435
3,745,937 A * 7/1973 Gail ..... 108/128
6,773,070 B2 * 8/2004 Worledge et al. ..... 297/344.21
2002/0117878 A1 * 8/2002 Fox ..... 297/16.2
2009/0174233 A1 * 7/2009 Hoffman et al. ..... 297/16.2

* cited by examiner

*Primary Examiner* — Peter R. Brown
(74) *Attorney, Agent, or Firm* — Tod R. Nissle, P.C.

(57) ABSTRACT

A swiveling folding chair is provided. The chair includes a fabric seat; a plurality of legs; a primary control tree having a first control shaft and having first, second, third, and fourth collars mounted on the control shaft. The legs are each attached to the first control collar, and, support arms are each attached to the second control collar and to the fabric seat. Elongate support members are each attached at one end to one of the legs and at the other end to the fourth control collar. Elongate brace members are each attached at one end to one of the arms and at the other end to the third control collar. The second control collar rotates about the first control collar so the seat rotates independently of the legs. The seat and legs fold into a stowed orientation.

2 Claims, 9 Drawing Sheets

FOLDING SWIVEL CHAIR

This invention pertains to chairs.

More particularly, the invention pertains to a folded chair which, when unfolded and deployed, has a seat that swivels independently of the legs of the chair.

Folding chairs have long been marketed. A folding chair having a seat which can, after the chair is unfolded, swivel does not appear to be readily available and to have successfully penetrated the market.

Accordingly, it would be highly desirable to provide an improved folding chair.

Therefore, it is a principal object of the invention to provide a swiveling folding chair.

These and other, further and more specific objects and advantages of the invention will be apparent from the following detailed description of the invention, taken in conjunction with the drawings, in which.

Figure 1:
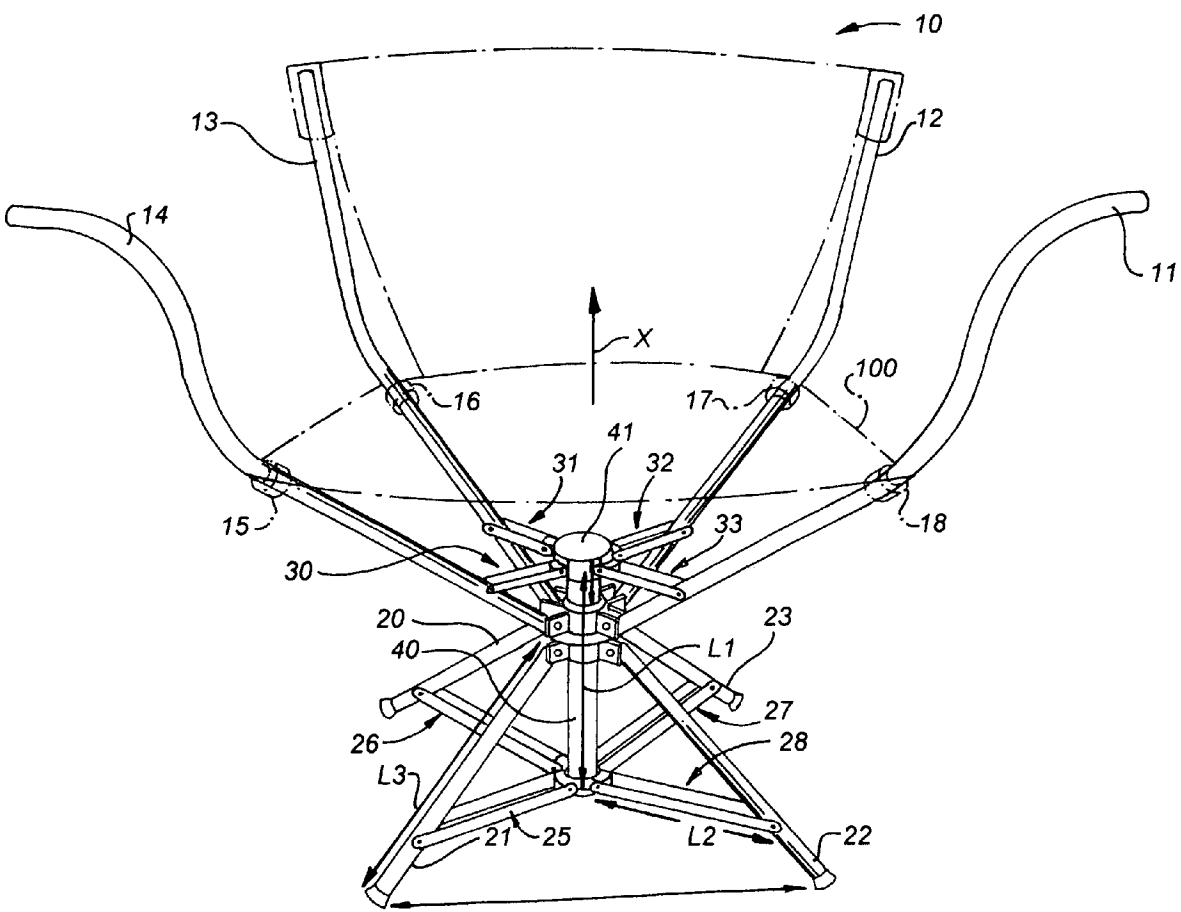
FIG. 1 is a perspective view illustrating the chair of the invention in the deployed orientation.

Briefly, in accordance with our invention, we provide an improved folding chair comprising a control tree including a control member including an elongate shaft. The shaft includes an elongate centerline; an upper end; a lower end; and, a central section intermediate the upper end and the lower end. The control member also includes a first-control collar. The collar includes an upwardly extending body, and a first aperture formed therethrough. The collar is mounted on the control member with the shaft slidably extending through the first aperture. The control member also includes a second control collar. The collar includes a second aperture formed therethrough. The second collar is mounted on the first control member with the body slidably extending through said second aperture to slide along the shaft simultaneously with the first control member, and rotate about the body and centerline independently of the first control member. The control member also includes a third control collar mounted on the upper end of the shaft to rotate about the upper end and the centerline. The control member also includes a fourth control collar fixedly mounted on the lower end of the shaft. The chair also includes at least three legs each including a proximate end pivotally attached to the first control member; at least upwardly extending support arms each including a proximate end pivotally attached to the second control member; a pliable foldable seat structure attached to the support arms; at least three elongate support members each operatively associated with a different one of the legs and including a first distal end pivotally attached to the leg and a second proximate end pivotally attached to the fourth control collar; at least three elongate brace members each operatively associated with a different one of the arms and including a primary distal end pivotally attached to the arm and a secondary proximate end pivotally attached to said the control collar. The shaft of the control member is slides through the first aperture between at least two operative positions, a first operative position with the chair stowed and folded, with the fourth control collar upwardly displaced toward the first control collar such that the second proximate ends are positioned above the first distal ends, and with the third control collar upwardly displaced away from the first control collard such that the secondary proximate ends are positioned above the primary distal ends; and, a second operative position with the chair deployed and unfolded, with the fourth control collar downwardly displaced away from the first control collar such that the second proximate ends are generally positioned level with or below the first distal ends, and with the third control collar downwardly displaced toward the first control collar such that the secondary proximate ends are generally positioned level with or below the primary distal ends.

In accordance with another embodiment of the invention, we provide an improved method of producing a swivel chair. The method comprises the initial step of providing a folding chair (10). The chair includes a first control tree including a first control member including an elongate shaft (40). The shaft includes an elongate centerline, an upper end, a lower end, and a central section intermediate the upper end and the lower end. The control tree also includes a first control collar (70) including an upwardly extending body (76), and a first aperture formed therethrough. The collar is slidably mounted on the first control member with the shaft slidably extending through the first aperture. The control tree also includes a second control collar (80) with a second aperture formed therethrough and mounted on the first control member with the body slidably extending through the second aperture to slide along the shaft simultaneously with the first control collar, and rotate about the body and centerline independently of the first control collar. The control tree also includes a third control collar (50) mounted on the upper end of the shaft (40) to rotate about the upper end and the centerline. The control tree also includes a fourth control collar (60) mounted on the lower end of the shaft (40). The chair also includes at least three legs (21, 22, 23) each including a proximate end pivotally attached to the first control collar; at least two upwardly extending support arms (12, 13) each including a proximate end pivotally attached to the second control collar; a pliable foldable seat structure (100) attached to the support arms; at least three elongate support members (25, 26, 27) each operatively associated with a different one of the legs and including a first distal end pivotally attached to one of the legs and a second proximate end pivotally attached to the fourth control collar (60); at least three elongate brace members (30, 31, 32) each operatively associated with a different one of the arms and including a primary distal end pivotally attached to one of the arms and a secondary proximate end pivotally attached to the third control collar (50). The shaft slidable through the first aperture between at least two operative positions, a first operative position with the chair stowed and folded; with the fourth control collar upwardly displaced toward the first control collar such that the second proximate ends are positioned above the first distal ends; and with the third control collar upwardly displaced away from the first control collar such that the secondary proximate ends are positioned above the primary distal ends; and, a second operative position with the chair deployed and unfolded, with the fourth control collar downwardly displaced away from the first control collar such that the second proximate ends are generally positioned level with or below the first distal ends, and with the third control collar downwardly displaced toward the first control collard such that the secondary proximate ends are generally positioned level with or below the primary distal ends. The method also includes the step of providing a test apparatus. The test apparatus includes a secondary control tree comparable to the first control tree. The secondary control tree includes a secondary control member comparable to the first control member and including an elongate shaft (40). The shaft (40) includes an elongate centerline, an upper end, a lower end, and a central section intermediate the upper end and the lower end. The secondary control tree also includes a primary control collar (70A) including a primary aperture formed therethrough and slidably mounted on the secondary control member; a secondary control collar (80A) with a secondary aperture formed therethrough and mounted on the secondary control member to slide along the shaft of the secondary control member simultaneously with the primary control collar; a tertiary control collar (50A) mounted on the upper end of the shaft of the secondary control member; and, a quaternary control collar (60A) mounted on the lower end of the shaft of the secondary control member. The test apparatus also includes first and second downwardly extending legs (21A, 23A) each including a proximate end pivotally attached to the primary control collar; a first sleeve (100) slidably mounted on the first leg; a second sleeve (200) slidably mounted on the second leg; first and second upwardly extending support arms (12A, 14A) each including a proximate end pivotally attached to the secondary control collar; a third sleeve (102) slidably mounted on the first arm; a fourth sleeve (103) slidably mounted on the second arm; first and second elongate support elements (106, 107) each having a length and operatively associated with a different one of the first and second legs and including a first distal end pivotally attached to a different one of the first and second sleeves and a second proximate end pivotally attached to the quaternary control collar; and, first and second elongate brace elements (108, 109) each having a length and operatively associated with a different one of the first and second arms and including a primary distal end pivotally attached to a different one of the third and fourth sleeves and a secondary proximate end pivotally attached to the tertiary control collar. The lengths of the first and second brace elements and the first and second support elements are adjustable. The shaft of the secondary control member is slidable through the primary and secondary apertures between at least two operative positions, a first operative position with the test apparatus stowed and folded, with the quaternary control collar (60A) upwardly displaced toward the primary control collar such that the second proximate ends of the first and second support elements (106, 107) are positioned above the first distal ends of the first and second support elements, and with the tertiary control collar (50A) upwardly displaced away from the first control collar such that the secondary proximate ends of the first and second brace elements (108, 109) are positioned above the primary distal ends of the first and second brace elements; and, a second operative position with the test apparatus deployed and unfolded, with the quaternary control collar downwardly displaced away from the primary control collar such that the second proximate ends of the first and second support elements are generally positioned level with or below the first distal ends of the first and second support elements, and with the tertiary control collar downwardly displaced toward the first control collar such that the secondary proximate ends of the first and second brace elements are generally positioned level with or below the primary distal ends of the first and second brace elements. The method also includes the step of manipulating at least one in a group consisting of the first and second support elements, of the first and second brace elements, and of the first, second, third, and fourth sleeves to determine a desired length for each of the support elements, a desired length for each of the brace elements, a desired position for each of the first and second sleeves along a different one of the first and second legs, and a desired position for each of the third and fourth sleeves along a different one of the first and second arms. The method also includes the steps of providing in the folding chair support members (25, 26, 27) each generally equivalent in length to the desired length for each of the support elements; providing in the folding chair brace members (30, 31) each generally equivalent in length to the desired length for each of the brace elements; pivotally attaching the distal ends of the support members to the legs of the folding chair at positions equivalent to the desired position of the first and second sleeves on the legs of the test apparatus; and pivotally attaching the distal ends of the brace members to the arms of the folding chair at positions equivalent to the desired position of the third and fourth sleeves on the arms of the test apparatus.

Turning now to the drawings, which depict the presently preferred embodiments of the invention for the purpose of illustrating the practice thereof and not by way of limitation of the scope of the invention, and in which like reference characters refer to corresponding elements throughout the several views, FIG. 1 illustrates a folding swivel chair constructed in accordance with the principles of the invention and generally indicated by reference character 10. In FIG. 1, chair 10 is in the deployed, unfolded configuration. Chair 10 includes legs 20 to 23 and support arms 11 to 14.

Figure 4:
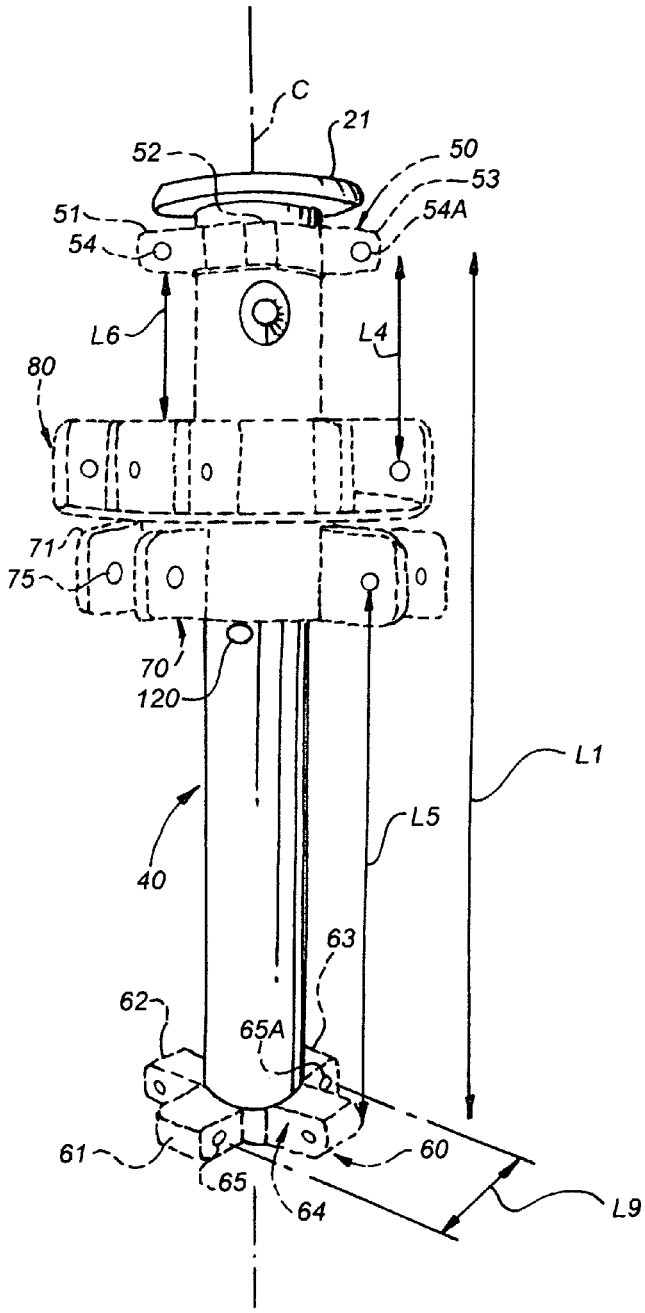
FIG. 4 is a side perspective view illustrating the control tree of the invention.

Chair 10 includes a control member illustrated in FIG. 4. The control member includes an elongate shaft 40, a first control collar 70, a second control collar 80, a third control collar 50, and a fourth control collar 60. Collar 50 is mounted on the upper end of shaft 40. Collar 60 is mounted on the lower end of shaft 40. Cap 21 is secured to the top of shaft 40. Shaft 40 presently has a length L1 (FIG. 4) of eleven inches. Length L1 is preferably in the range of ten to thirteen inches. The length of shaft 40 is restricted by the fact that when chair 10 is in the deployed configuration of FIG. 1, cap 21 and the top of shaft 40 preferably must be positioned above the bottom of the seat of chair 10, and is preferably below and spaced apart from the bottom of the seat when an individual is sitting in the chair. Further, when chair 10 is in the deployed configuration of FIG. 1, collar 50 must be positioned such that brace members 30 to 33 (FIG. 1) slope inwardly downwardly so that the apertures or pivot points 54, 54A in collar 50 are positioned at the same or a lower elevation than the pivot points at which members 30 to 33 are connected to arms 11 to 14. If, when chair 10 is deployed, the pivot points 54, 54A are positioned above the pivot points at which members 30 to 33 are connected to arms 11 to 14, then when an individual sits in chair 10 forces are generated which tend to force shaft 40 upwardly and move chair 10 to the stowed configuration of FIG. 2.

Collar 50 is mounted on a washer (not shown) that seats in a groove (not shown) in the upper end of shaft 40 or is otherwise mounted on shaft 40 such that collar 50 is free to rotate about shaft 40 and the centerline, indicated by dashed line C', of shaft 40 but can not slide along shaft 40, i.e., collar 50 is permanently located at the upper end of shaft 40 and cannot slide downwardly along shaft 40 toward the lower end of shaft 40. The distance between an opposing pair of apertures, or pivot points, 54 and 54A (FIG. 4) in collar 50 is presently equivalent to the distance L9 between an opposing pair of apertures 65, 65A in collar 60 (FIG. 4). This distance is presently two and one-half inches and is preferably in the range of one to five inches, most preferably two to three inches.

Collar 60 is permanently mounted on the lower end of shaft 40, does not rotate about shaft 40, and can not slide upwardly along shaft 40 toward the upper end of shaft 40. The shape and dimension of collar 60 is presently equivalent to that of collar 50, although that need not be the case.

As is described below in further detail, shaft 40 slides upwardly and downwardly through apertures formed in the first 70 and second 80 collars.

Figure 5:
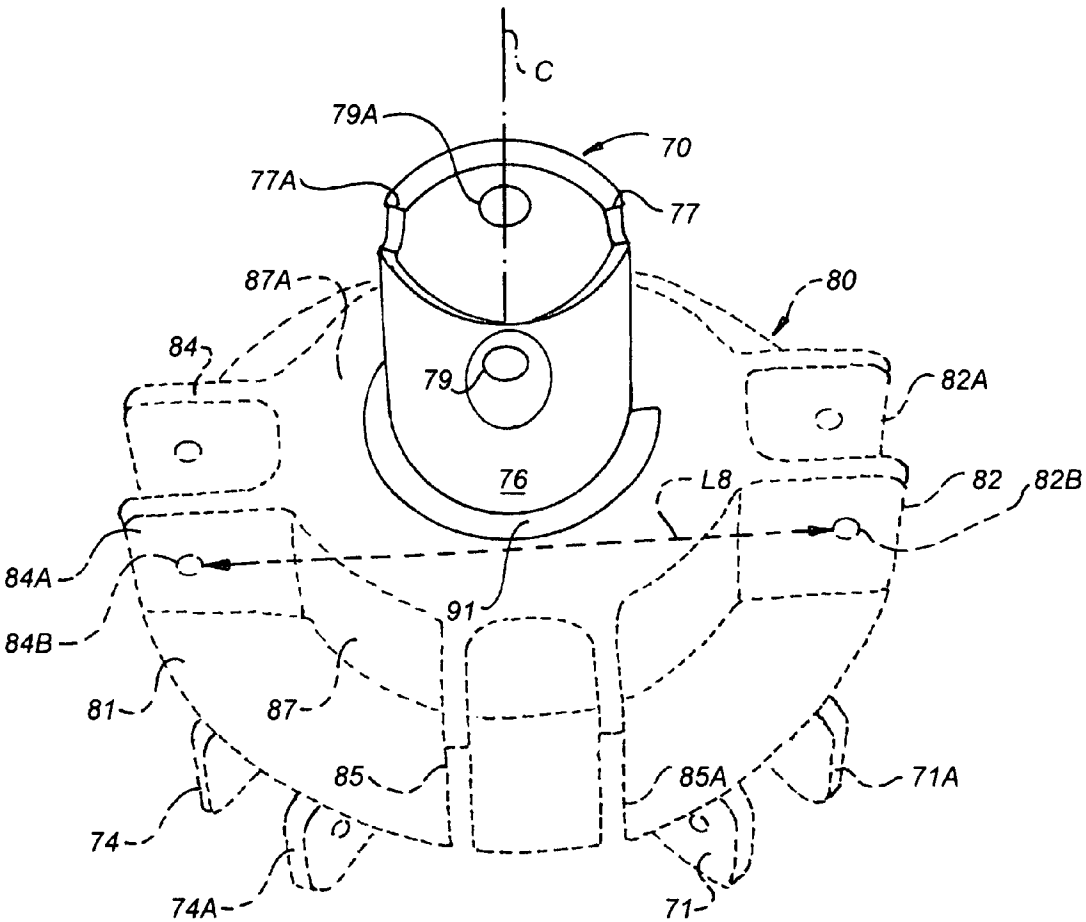
FIG. 5 is top perspective view illustrating two components of the control tree of FIG. 4.
Figure 8:
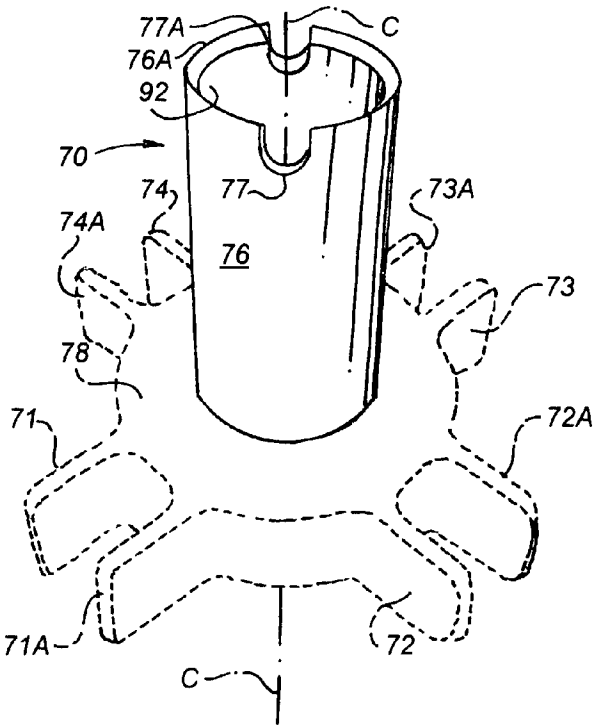
FIG. 8 is a top perspective view further illustrating the component of FIG. 7; and, FIG. 9 is a top view of an apparatus utilized to test and define linkage dimensions in the chair of the invention.
Figure 7:
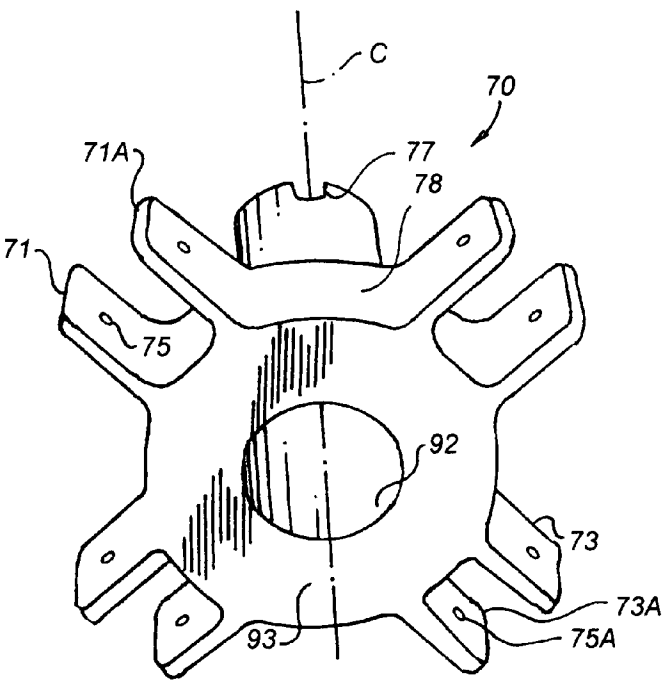
FIG. 7 is a bottom perspective view further illustrating one of the components of FIG. 5.

Collar 70 is depicted in more detail in FIGS. 7 and 8 and includes hollow cylindrical body 76 upwardly depending from cylindrical base 78. Body 76 includes upper circular lip 76A. Cylindrical aperture 92 extends through base 78 and body 76. U-shaped grooves 77 and 77A are formed in the distal end of body 76. Spaced apart flange pairs 71-71A, 72-72A, 73-73A, and 74-74A outwardly depend from body 76. Each flange 71, 71A, 72, 72A, 73, 73A, 74, 74A includes an aperture 75 formed therethrough. The distance between an opposing pair of apertures, or pivot points, 75 and 75A (FIG. 7) in collar 70 is presently equivalent to the distance L8 between an opposing pair of apertures 84B, 82B in collar 80 (FIG. 5). This distance is presently four and one-quarter inches and is preferably in the range of three to six inches, most preferably three and one-half to five and one-half inches. When distance between an opposing pair of apertures 75, 75A is less than three inches, this increases the torque or other forces acting on shaft 40 and body 87 of collar 80 and increases the likelihood that shaft 40 or body 87 will be deformed when an individual sits in chair 10. Importantly, when collars 70 and 80 have a greater distance between opposing aperture pairs 75-75A or 84B-82B, this appears to distribute some of the forces to the peripheral flange portions of the collar and reduce the likelihood that shaft 40 and body 87 will be deformed.

Figure 1A:
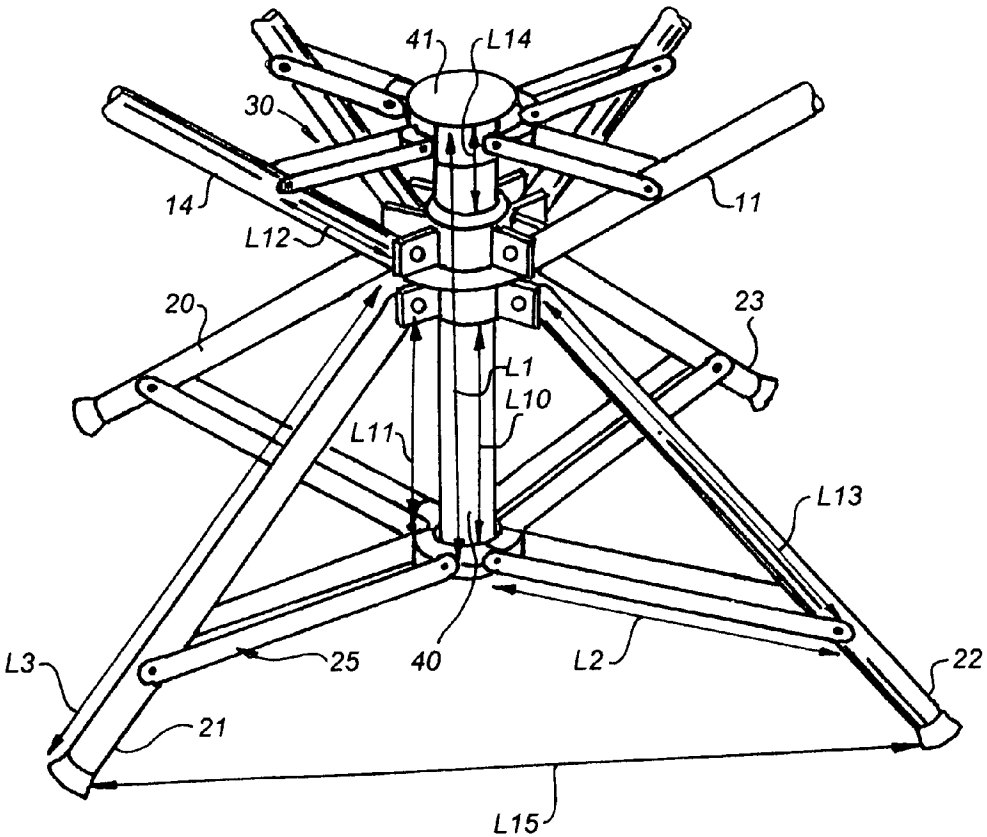
FIG. 1A is a perspective view illustrating a portion of the char of FIG. 1.
Figure 3:
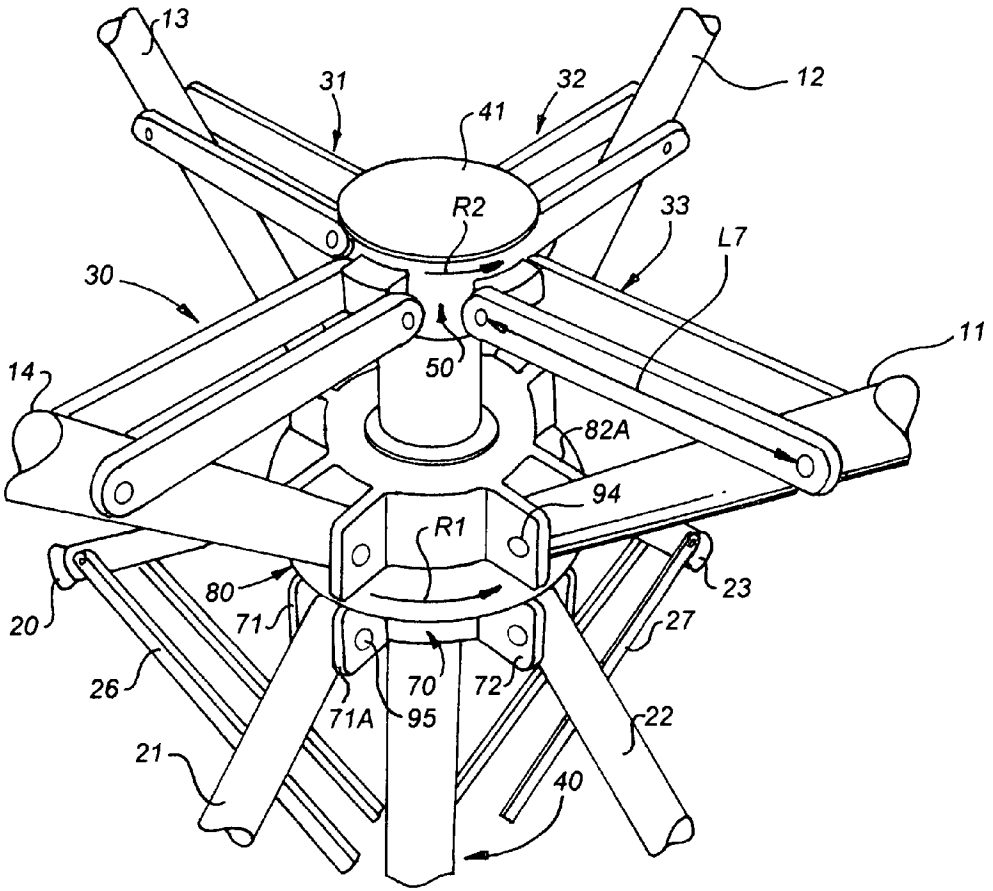
FIG. 3 is a perspective view illustrating a portion of the chair of the invention in the deployed orientation and the mode of operation thereof.

In FIG. 1A, which represents one preferred embodiment of the invention, the distance L3 is in the range of twelve to sixteen niches and is presently fourteen inches; the distance L2 is in the range of ten to twelve inches and is presently eleven inches; the distance L14 is presently in the range of two to three inches and is presently two and one-quarter inches; the distance L12 is in the range of four to four and one-half inches and is presently four and one-half inches; the distance L15 is presently about twenty inches; the distance L13 is in the range of ten to thirteen inches and is presently eleven and three-fourths inches; the distance L10 is in the range of six to seven inches and is presently six and three-eighths inches; and, the distance L11 is in the range of six to eight inches and is presently seven and one-quarter inches. In FIG. 1A the distance indicated by arrows L11 is equivalent to that indicated by arrows L5 in FIG. 4. The distance L4 indicated in FIG. 4 represents the shortest distance between an aperture 54A in collar 50 and an apertures in collar 80 that is directly below aperture 54A when the chair 10 is in the deployed configuration of FIG. 1. In FIG. 4, the distance indicated by arrows L6 is the distance between the bottom of collar 50 and the top of collar 80 when chair 10 is in the deployed configuration of FIG. 1. In FIG. 3, the distance L7 is in the range of four to five inches and is presently four and one-half inches.

Figure 6:
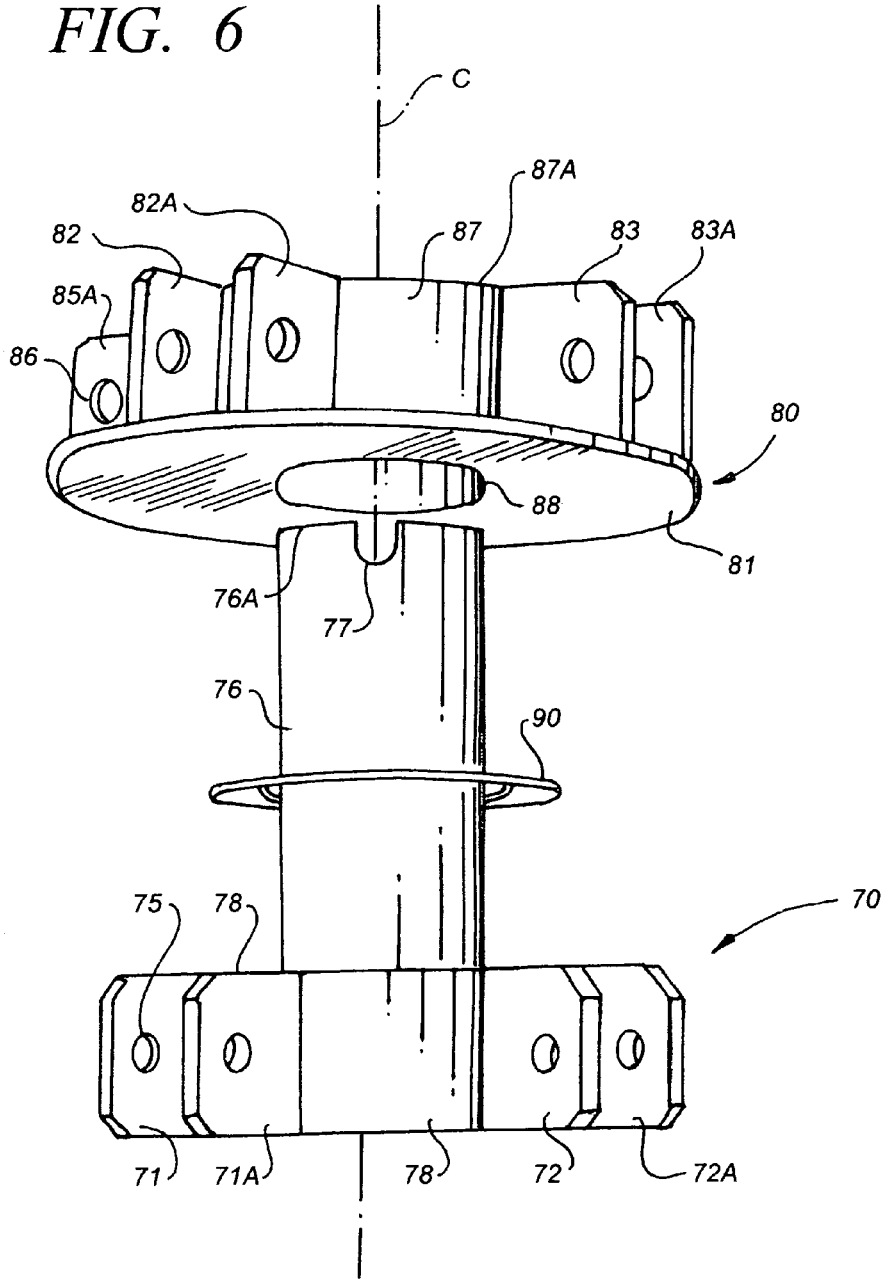
FIG. 6 is a side perspective view further illustrating the components of FIG. 5.

Collar 80 is depicted in more detail in FIGS. 5 and 6, and includes circular plate 81 and cylindrical body 87 upwardly depending from plate 81. Body 87 includes upper surface 87A that is generally perpendicular to centerline C and is generally parallel to plate 81. Spaced apart flange pairs 82-82A, 83-83A, 84-84A, and 85-85A outwardly extend from body 87 and upwardly depend from plate 81. Each flange 82, 82A, 83, 83A, 84, 84A, 85, 85A includes an aperture formed therethrough.

FIGS. 5 and 6 illustrate how collar 80 is slidably mounted on body 76 of collar 70 to a position adjacent the upper surface of base 78 of collar 70. One or more washers 90 are mounted on body 76 intermediate collars 70 and 80. Once collar 80 is mounted on collar 70, a lock washer 91 prevents collar 80 from sliding from the position illustrated in FIG. 5 and upwardly along body 76 away from washer 90 and collar 70 toward U-shaped grooves 77, 77A.

In FIG. 3, the proximate or lower end of arm 11 is pivotally secured intermediate flange pair 82-82A by a pin 94 that extends through apertures 86 and through the lower end of arm 11. The proximate end of arm 12 is similarly pivotally mounted intermediate flange pair 83-83A; the proximate end of arm 13 is similarly pivotally mounted intermediate flange pair 84-84A; and, the proximate end of arm 14 is similarly pivotally mounted intermediate flange pair 85-85A of collar 80.

In FIG. 3, the proximate or upper end of leg 21 is pivotally secured intermediate flange pair 71-71A by a pin 95 that extends through apertures 75 and through the upper end of leg 21. The proximate end of arm 22 is similarly pivotally mounted intermediate flange pair 72-72A; the proximate end of arm 23 is similarly pivotally mounted intermediate flange pair 73-73A, and the proximate end of arm 20 is similarly pivotally mounted intermediate flange pair 74-74A.

Support member 25 in FIGS. 1 and 3 is pivotally secured both at one end to leg 21 and at the other end to a flange 60 to 63 of collar 60. Member 25 is pivotally fastened to collar 60 by a pin extending through an aperture 65 (FIG. 4) and through one end of member 25. Leg 21 has a length generally indicated by arrow L3 in FIG. 1. The length of each of the other legs 20, 22, 23 is equivalent to the length indicated by arrow L3. Support member 26 is similarly pivotally secured both at one end to leg 20 and at the other end to a flange 60 to 63 of collar 60. Support member 27 is similarly pivotally secured both at one end to leg 23 and at the other end to a flange 60 to 63 of collar 60. Support member 28 is similarly pivotally secured both at one end to leg 22 and at the other end to a flange 60 to 63 of collar 60. Support member 28 has a length indicated by arrows L2 in FIG. 1. The length of each of the other support members 25 to 27 is equivalent to the length of member 28.

Brace member 33 in FIGS. 1 and 3 is pivotally secured both at one end to arm 11 and at the other end to a flange 51 to 53 of collar 50. Member 33 is pivotally fastened to collar 50 by a pin extending through an aperture 54 and through one end of member 33. Member 33 has a length, comparable to that indicated by arrows L7, that extends from the pivot point at one end of member 33 to the pivot point at the other end of member 33. The length of each of the other brace members 30 to 32 is equivalent to that of member 33. Brace member 32 is similarly pivotally secured at one end to arm 12 and at the other end to a flange 51 to 53 of collar 50. Brace member 31 is similarly pivotally secured at one end to arm 13 and at the other end to a flange 51 to 53 of collar 50. Brace member 30 is similarly pivotally secured at one end to arm 14 and at the other end to a flange 51 to 53 of collar 50.

Bushings 16 to 18 are, as illustrated in FIG. 1, each mounted on a different one of arms 11 to 14 and function as stops to support seat structure 100 and prevent seat structure 100 from sliding or moving past bushings 16 to 18 toward the ground. While seat structure 100 need not be pliable and can take on any desired construct, seat structure 100 is presently preferably formed from a pliable canvas-like material and includes opening formed therethrough that permit structure 100 to slid in conventional fashion down over the distal ends of arms 11 to 14 to the position indicated in FIG. 1 by dashed lines 100.

The arms 11 to 14 and the legs 20 to 23 are illustrated in the deployed unfolded configuration in FIG. 3. In the deployed configuration of FIG. 3, collar 80 can rotate around body 76 (FIG. 6) of collar 70 and collar 50 can, simultaneously with the rotation of collar 80, rotate about shaft 96 in the directions indicated by arrow R1 and R2, respectively. When collars 50 and 80 rotate in the directions indicated by arrows R2 and R1, arms 11 to 14 and a pliable foldable seat structure 100 rotate, or swivel, simultaneously with collars 50 and 80. Accordingly, the arms 11 to 14 and seat structure swivel independently of the legs 20 to 23.

In use, chair 10 is, as noted, in the unfolded deployed position in FIG. 1. Chair 10 is moved to the folded stowed position of FIG. 2 by slidably displacing shaft 40 upwardly in the direction of arrow X while maintaining collars 70 and 80 in fixed position. Collars 50 and 60 move upwardly simultaneously with shaft 40. When shaft 40 moves upwardly in this manner, the proximate ends of support members 25 to 28 move upwardly with collar 60 to draw inwardly legs 20 to 23; and, the proximate ends of brace members 30 to 33 move upwardly with collar 50 to draw arms 11 to 14 inwardly to the position illustrated in FIG. 2. If desired, seat structure 100 can be removed from chair 10 before chair 10 is folded into the stowed configuration. The procedure set forth in this paragraph is reversed to move chair 10 from the folded configuration to the unfolded deployed configuration.

The length of shaft 40 is indicated by arrows L1 in FIGS. 1 and 4. When the chair 10 is in the deployed orientation of FIG. 1, collar 60 is preferably, but not necessarily, at an elevation that is equivalent to or below the elevation of the points at which support members 25 to 28 are pivotally attached to their associated legs 20 to 23.

In an alternate embodiment of the invention collar 50 is fixedly attached to and rotates with shaft 40, and collar 60 is mounted on the lower end of shaft 40 such that the lower end of shaft 40 rotates within collar 60. In this embodiment of the invention, when the arms 11 to 14 of the chair swivel, shaft 40 and collars 50 and 80 simultaneously rotate with arms 11 to 14 while collars 60 and 70 do not rotate.

When chair 10 is in the deployed configuration of FIG. 1, the distance between collars 50 and 80 is indicated by arrows L6 in FIG. 4. The distance between the center of an aperture in collar 50 and the center of an aperture in collar 80 is indicated by arrows L4. The distance between an aperture in collar 70 and an aperture on collar 60 is indicated by arrows L5 in FIG. 4.

Determining the proper sizes of chair components such that the folding chair would operate properly was a difficult problem. Changing the size of only one component could affect other components and make the chair not operate properly. Consequently, the test apparatus of FIG. 9 was developed.

Figure 9:
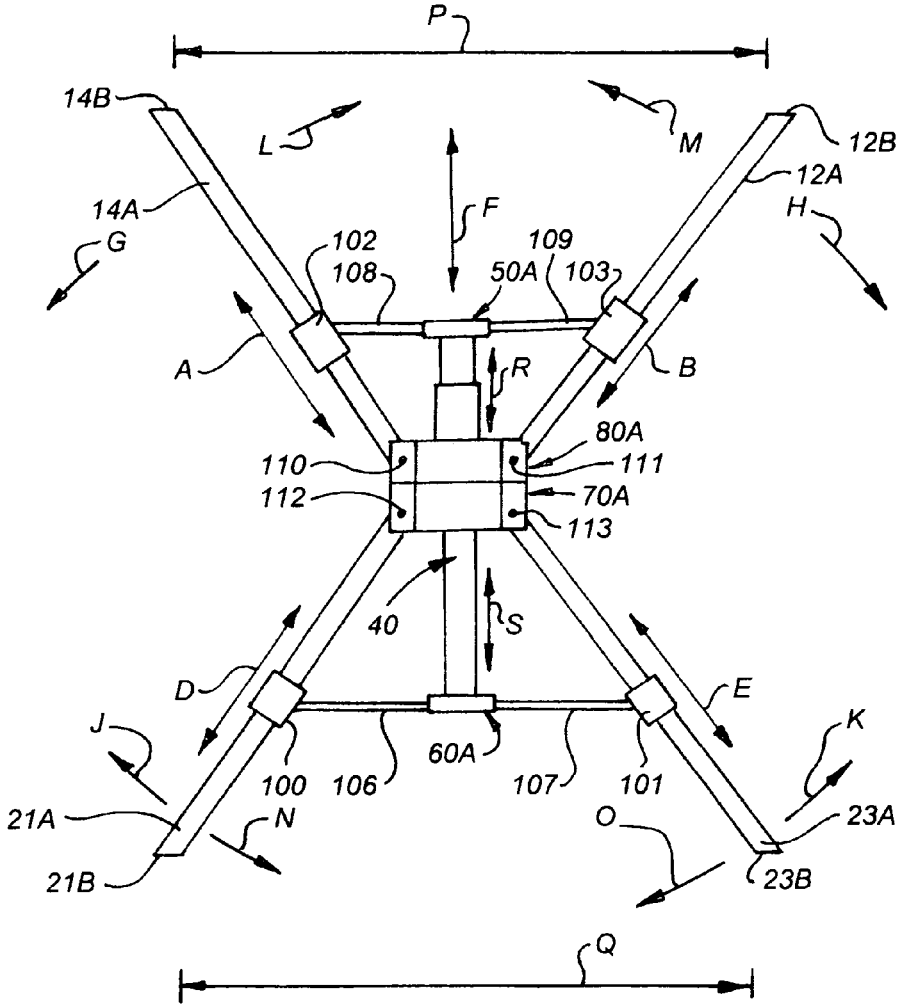

FIG. 9 is a top view and illustrates the apparatus laying substantially flat on a table top. The arms 12A and 14A and the legs 21A and 23A generally lay in a common horizontal plane. Arms 12A and 14A are generally equivalent to the opposed diagonal arms 12 and 14 in FIG. 1. Legs 21A and 23A are generally equivalent to the opposed diagonal legs 21 and 23 in FIG. 1.

Arms 12A and 14A have distal ends 12B and 14B, respectively. When the chair of the invention is in the deployed configuration of FIG. 1 the distance between the distal ends of arms 12 and 14 (or between other selected points on arms 12, 14) is a selected distance. This selected distance is indicated in FIG. 9 by arrows P.

Legs 21A and 23A have distal ends 21B and 23B, respectively. When the chair of the invention is in the deployed configuration of FIG. 1, the distance between the distal ends of legs 21 and 23 (or between other selected points on legs 21, 23) is a selected distance. This selected distance between the distal ends of legs 21 and 23 is indicated in FIG. 9 by arrows Q, and is presently equal to the distance indicated by arrows L15 in FIG. 1A.

Collars 100, 101, 102, 103 slide along legs 21A, 23A and arms 14A, 12A, respectively. Each collar 100-103 is detachably secured in a desired position with a set screw.

Tube 40 is slidably adjusted through collars 70A and 80A in the directions indicated by arrows F. The configuration illustrated in FIG. 9 is an open configuration. To move the test apparatus of FIG. 9 to the closed configuration (in which arms 14A and 12A are drawn together and legs 21A and 23A are drawn together), tube 40 is slid upwardly through collars 70A and 80A such that collar 50A moves away from collar 80A.

The lengths of each link 108 and 109 is adjustable, either by inserting links 108, 109 of different lengths or by making links 108 and 109 that telescope to different lengths. The length of each link 106, 107 is adjustable, either by inserting links 106, 107 of different lengths or by making links 108 and 109 adjustable.

The position of collar 50A on tube 40 can be varied by sliding collar 50A along tube 40 to a desired position and then detachably fixing collar 50A in position with a set screw.

The position of collar 60A on tube 40 can be varied by sliding collar 50A along tube 40 to a desired position and then detachably fixing collar 60A in position with a set screw.

If desired tubes 40 of different lengths can be utilized in the apparatus of FIG. 9.

Figure 2:
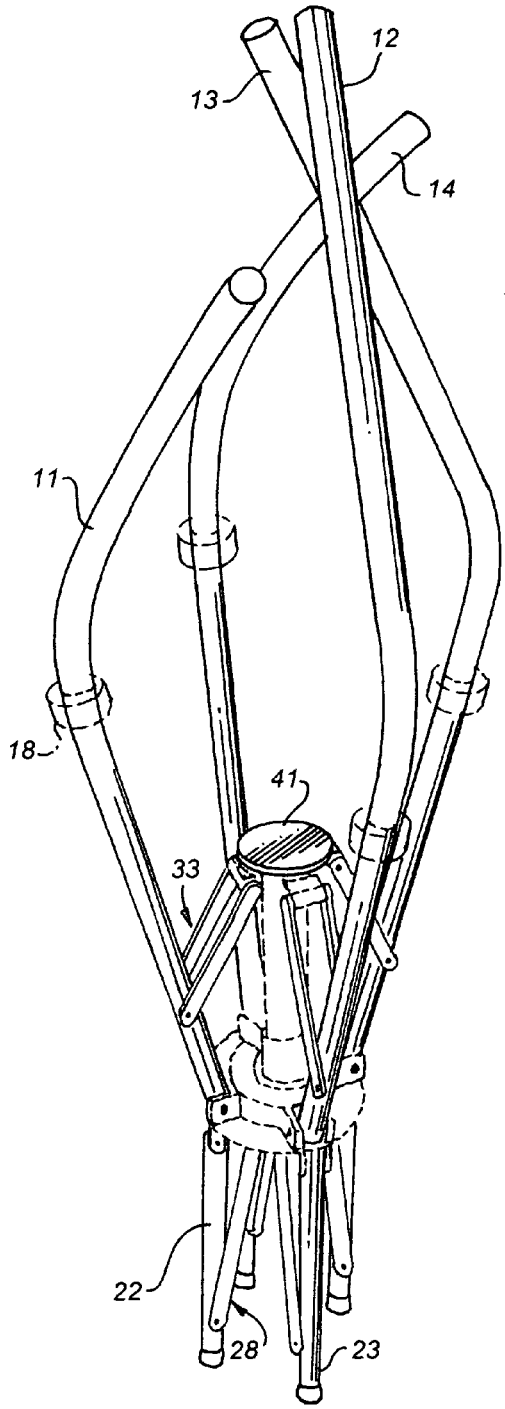
FIG. 2 is a perspective view illustrating the chair of the invention in the stowed orientation.

The purpose of the apparatus of FIG. 9 is to adjust the position or length, as the case may be, of collars 100 to 103, links 106 to 109, collar 50A, collar 60A, and/or tube 40 until desired distances P and Q are achieved in the open configuration illustrated in FIG. 9, until arms 12A and 14A close to a desired position in a stowed configuration comparable to the stowed configuration illustrated in FIG. 2, and until legs 21A and 23A close to a desired position in a stowed configuration comparable to the stowed configuration illustrated in FIG. 2.

Tube 40 can not, in accordance with the invention, be overly long because collar 50A must be spaced apart from and positioned beneath the seat 100 when the chair 10 is in the deployed configuration of FIG. 1. Practically speaking, for an adult "camping" chair of conventional size it has been determined that tube 40 must have a length L1 of less than thirteen inches, preferably in the range of eleven to thirteen inches long. The diameter of tube 40 is presently about one and one-quarter inches. This diameter can also be varied, in which case the diameter and size of a collar 50, 60, 70, 80 (FIG. 4) can be varied, and the distance L8 (FIG. 5) between a pair of pivot points on a collar can be varied. The outer diameter of tube 40 is generally no less than three-fourths of an inch. As the distance L8 is reduced, the torque generated on tube 40 increases. As the distance L8 is increased, more of the force generated by a person sitting in the chair is believed to transfer from collar 80 to collar 70 and legs 20 to 23 and lessen the torque that collar 80 generates against member 76 and tube 40. In the presently preferred embodiments of the invention, the distance L8 between a pair of opposed apertures, or pivot points, in a collar 70, 80 is in the range of three to five and one-half inches. The distance L9 between a pair of opposed apertures or pivot points 54, 54A or 65, 65A in a collar 50, 60 is presently two and one-half inches and is preferably in the range of two to three inches. Collars 70A, 80A with a distance L8 of four and one-quarter inches between opposing pivot points in a pivot point pair 110-111 or 112-113, and collars 50A and 60A with a distance L9 of two and one-half inches between opposing pivot points in a pivot point pair were used in the test apparatus of FIG. 9 to simulate collars 50, 60, 70, 80. A tube 40 with a diameter of one and one-quarter inches was used in the test apparatus of FIG. 9. Consequently, collar 80A was sized so the pivot points receiving the proximate (lower) ends of arms 12A and 14A were four and one-quarter inches apart; collar 70A was sized so the pivot points receiving the proximate (upper) ends of arms 21A and 23A were four and one-quarter inches apart; collar 60A was sized such that the pivot points receiving the inner ends of links 106 and 107 were two and one-half inches apart; and, collar 50A was sized such that the pivot points receiving the inner ends of links 108 and 109 were two and one-half inches apart. The outer end of each link 108 and 109 is pivotally attached to its respective collar 102, 103. The outer end of each link 106, 107 is pivotally attached to its respective collar 100, 101. The apparatus is then adjusted to obtain distances P and Q when the apparatus is in the deployed orientation of FIG. 9 and to achieve a desired closed configuration generally comparable to that of FIG. 2. Such is adjustment is made by:

1. First positioning collar 60A at a selected point on the lower end of tube 40.
2. Positioning collars 100 and 101 at selected points on legs 21A and 23A.
3. Varying lengths of links 106 and 107 are tested until legs 21A and 23A open a desired distance when the test apparatus is in the deployed configuration of FIG. 9 and until legs 21A and 23A close to a storage configuration that is generally comparable to that illustrated in FIG. 2 or that is otherwise desired. If the length of links 106 and 107 can not be varied to achieve the desired result, the collars 100 and 101 are repositioned to different points along legs 21A and 23A and different lengths of links 106 and 107 are tested. Links 106 and 107 correspond to members 26 and 27 in FIG. 1.
4. After an acceptable length is achieved for links 106 and 107, collar 50A is positioned at a selected point on the upper end of tube 40.
5. Collars 102 and 103 are positioned at selected points on legs 14B and 12B.
6. Varying lengths of links 108 and 109 are tested until arms 14A and 12A open a desired distance when the test apparatus is in the deployed configuration of FIG. 9 and until arms 14A and 12A close to a storage configuration that is generally comparable to that illustrated in FIG. 2 or that is otherwise desired. If the length of links 108 and 109 can not be varied to achieve the desired result, the collars 102 and 103 are repositioned along arms 14A, 12A and different lengths of links 108 and 109 are tested. Links 108 and 109 are generally equivalent to members 30 and 32 in FIG. 1. If collars 108 and 109 can not be positioned so that links of a particular length can be identified to position arms 14A, 12A a desired distance apart in the deployed configuration of FIG. 1 and at a desired located in the storage configuration, then the process is continued by repeating steps 1 to 6. Since links 108 and 109 must necessarily be shorter than links 106, 107 so that the top of tube 40 will be lower than the bottom of the seat of chair 10 when chair 10 is in the deployed configuration of FIG. 1, determining the length of links 108 and 109 allows less room for error since a small sliding movement of tube 40 produces a greater displacement of arms 14A, 12A than of legs 21A, 23A. Positioning collars 102 and 103 closer to collar 80A permit links 108 and 109 to be shortened. During the adjustment process, the location of collars 50A and 60A on tube 40 can also be adjusted.
7. After desired lengths for links 106, 107, 108, 109 are determined; after the desired positions for sleeves 100, 101, 102, 103 are determined; and, after the desired positions of collars 50A and 60A are determined chair 10 can be assembled. The desired length determined for each of links 106 and 107 corresponds to the length that is used for members 25 to 28. The desired length that is determined for each of links 108 and 109 corresponds to the length that is used for members 30 to 33. The position of each sleeve 100, 101 on its respective leg 21A, 23A corresponds to the position at which the distal end of each member 25 to 28 is pivotally attached to a leg 20 to 23, which position is, after the proximate end of each leg 20 to 23 is pivotally secured to collar 80, a defined distance along each leg 20 to 23 from collar 80. The position of each sleeve 102, 103 on its respective arm 14A, 12A corresponds to the position at which the distal end of each member 30 to 33 is pivotally attached to an arm 11-14, which position is, after the proximate end of each arm 11-14 is pivotally secured to collar 70, a defined distance along each arm 11-14 from collar 70.

In another embodiment of the invention, the test apparatus of FIG. 9 is first used in the general manner noted above to determine the length of links 108 and 109, after which the length of links 106 and 107 is determined.

Having described our invention in such terms as to enable those of skill in the art to make and practice it, and having described the presently preferred embodiments thereof, We claim:

1. A folding chair comprising (a) a primary control tree including
  (i) a first elongate control shaft, said control shaft including
    an elongate centerline,
    an upper end,
    a lower end, and
    a central section intermediate said upper end and said lower end,
  (ii) a first control collar including
    an upwardly extending body, and
    a first aperture formed therethrough,
  said collar mounted on said control shaft with said control shaft slidably extending through said first aperture,
  (iii) a second control collar with a second aperture formed therethrough and mounted on said control shaft with said body slidably extending through said second aperture to
    slide along said control shaft simultaneously with said first control collar, and
    rotate about said body of said first control collar and about said centerline independently of said first control collar
  (iii) a third control collar mounted on said upper end of said control shaft to rotate about said centerline, and
  (iv) a fourth control collar mounted on said lower end of said control shaft;

(b) at least three legs each including a proximate end pivotally attached to said first control collar;

(c) at least three upwardly extending support arms each including a proximate end pivotally attached to said second control collar;

(d) a pliable foldable seat structure attached to said support arms;

(e) at least three elongate support members each operatively associated with a different one of said legs and including a first distal end pivotally attached said one of said legs and a second proximate end pivotally attached to said fourth control collar;

(f) at least three elongate brace members each operatively associated with a different one of said arms and including a primary distal end pivotally attached to said one of said arms and a secondary proximate end pivotally attached to said third control collar;

said control shaft slidable through said first aperture between at least two operative positions, (g) a first operative position with (i) said chair stowed and folded, (ii) said fourth control collar upwardly displaced toward said first control collar such that said second proximate ends are positioned above said first distal ends, (iii) said third control collar upwardly displaced away from said first control collar such that said secondary proximate ends are positioned above said primary distal ends, and (h) a second operative position with (i) said chair deployed and unfolded, (ii) said fourth control collar downwardly displaced away from said first control collar such that said second proximate ends are generally positioned level with or below said first distal ends, and (iii) said third control collar downwardly displaced toward said first control collar such that said secondary proximate ends are generally positioned level with or below said primary distal ends.

2. A method of producing a swivel chair, comprising the steps of:

(I) providing a folding chair (10) comprising (a) a first control tree including (i) a first elongate control shaft (40), said control shaft including an elongate centerline, an upper end, a lower end, and a central section intermediate said upper end and said lower end, (ii) a first control collar (70) including an upwardly extending body (76), and a first aperture formed therethrough, said collar slidably mounted on said control shaft with said control shaft slidably extending through said first aperture, (iii) a second control collar (80) with a second aperture formed therethrough and mounted on said control shaft with said body slidably extending through said second aperture to slide along said shaft simultaneously with said first control collar, and rotate about said body and centerline independently of said first control collar, (iii) a third control collar (50) mounted on said upper end of said control shaft (40) to rotate about said centerline, and (iv) a fourth control collar (60) mounted on said lower end of said control shaft (40);

(b) at least first, second, and third legs (21, 22, 23) each including a proximate end pivotally attached to said first control collar;

(c) at least first, second, and third upwardly extending support arms (12, 13) each including a proximate end pivotally attached to said second control collar;

(d) a pliable foldable seat structure (100) attached to said support arms;

(e) at least three elongate support members (25, 26, 27) each operatively associated with a different one of said legs and including a first distal end pivotally attached said one of said legs and a second proximate end pivotally attached to said fourth control collar (60);

(f) at least three elongate brace members (30, 31, 32) each operatively associated with a different one of said arms and including a primary distal end pivotally attached to said one of said arms and a secondary proximate end pivotally attached to said third control collar (50);

said control shaft slidable through said first aperture between at least two operative positions, (g) a first operative position with (i) said chair stowed and folded, (ii) said fourth control collar upwardly displaced toward said first control collar such that said second proximate ends are positioned above said first distal ends, (iii) said third control collar upwardly displaced away from said first control collar such that said secondary proximate ends are positioned above said primary distal ends, and (h) a second operative position with (i) said chair deployed and unfolded, (ii) said fourth control collar downwardly displaced away from said first control collar such that said second proximate ends are generally positioned level with or below said first distal ends, and (iii) said third control collar downwardly displaced toward said first control collar such that said secondary proximate ends are generally positioned level with or below said primary distal ends;

(II) providing a test apparatus comprising (a) a secondary control tree comparable to said first control tree and including (i) a secondary elongate control shaft comparable to said first control shaft, said secondary control shaft including an elongate centerline, an upper end, a lower end, and a central section intermediate said upper end and said lower end, (ii) a primary control collar (70A) including a primary aperture formed therethrough, and slidably mounted on said secondary control shaft, (iii) a secondary control collar (80A) with a secondary aperture formed therethrough and mounted on said secondary control shaft to slide along said secondary control shaft simultaneously with said primary control collar, (iii) a tertiary control collar (50A) mounted on said upper end of said secondary control shaft, and (iv) a quaternary control collar (60A) mounted on said lower end of said secondary control shaft;

(b) primary and secondary downwardly extending legs (21A, 23A) each including a proximate end pivotally attached to said primary control collar;

(c) a first sleeve (100) slidably mounted on said primary leg;

(d) a second sleeve (200) slidably mounted on said secondary leg;

(e) primary and secondary upwardly extending support arms (12A, 14A) each including a proximate end pivotally attached to said secondary control collar;

(f) a third sleeve (102) slidably mounted on said primary arm;

(g) a fourth sleeve (103) slidably mounted on said secondary arm;

(h) first and second elongate support elements (106, 107) each having a length and operatively associated with a different one of said primary and secondary legs and including a first distal end pivotally attached to a different one of said first and second sleeves and a second proximate end pivotally attached to said quaternary control collar;

(i) first and second elongate brace elements (108, 109) each having a length and operatively associated with a different one of said primary and secondary arms and including a primary distal end pivotally attached to a different one of said third and fourth sleeves and a secondary proximate end pivotally attached to said tertiary control collar;

said lengths of said first and second brace elements and said first and second support elements being adjustable, said secondary control shaft slidable through said primary and secondary apertures between at least two operative positions, (g) a first operative position with (i) said test apparatus stowed and folded, (ii) said quaternary control collar (60A) upwardly displaced toward said primary control collar such that said second proximate ends of said first and second support elements (106, 107) are positioned above said first distal ends of said first and second support elements, (iii) said tertiary control collar (50A) upwardly displaced away from said first control collar such that said secondary proximate ends of said first and second brace elements (108, 109) are positioned above said primary distal ends of said first and second brace elements, and (h) a second operative position with (i) said test apparatus deployed and unfolded, (ii) said quaternary control collar downwardly displaced away from said primary control collar such that said second proximate ends of said first and second support elements are generally positioned level with or below said first distal ends of said first and second support elements, and (iii) said tertiary control collar downwardly displaced toward said first control collar such that said secondary proximate ends of said first and second brace elements are generally positioned level with or below said primary distal ends of said first and second brace elements;

(III) manipulating at least one in a group consisting of (a) said first and second support elements, (b) said first and second brace elements, and (c) said first, second, third, and fourth sleeves to determine (d) a desired length for each of said support elements, (e) a desired length for each of said brace elements, (f) a desired position for each of said first and second sleeves along a different one of said primary and secondary legs, and (g) a desired position for each of said third and fourth sleeves along a different one of said primary and secondary arms;

(IV) providing in said folding chair support members (25, 26, 27) each generally equivalent in length to said desired length for each of said support elements, (V) providing in said folding chair brace members (30, 31) each generally equivalent in length to said desired length for each of said brace elements;

(VI) pivotally attaching said distal ends of said support members to said legs of said folding chair at positions equivalent to said desired position of said first and second sleeves on said primary and secondary legs of said test apparatus; and (VII) pivotally attaching said distal ends of said brace members to said arms of said folding chair at positions equivalent to said desired position of said third and fourth sleeves on said primary and secondary arms of said test apparatus.

* * * * *